US005584436A

United States Patent [19]

Sepke

[11] Patent Number: 5,584,436

[45] Date of Patent: Dec. 17, 1996

[54] PORTABLE BLOWER WITH DETACHABLE NOZZLE

[75] Inventor: Arnold L. Sepke, Hudson, Ill.

[73] Assignee: White Consolidated Industires, Inc., Cleveland, Ohio

[21] Appl. No.: 342,161

[22] Filed: Nov. 18, 1994

[51] Int. Cl.[6] ..... B05B 9/08; B05B 15/08

[52] U.S. Cl. ..... 239/154; 239/195; 239/588; 15/414

[58] Field of Search ..... 239/152–154, 239/195, 289, 525, 588, DIG. 12; 47/234; 15/327.5, 330, 328, 344, 405, 414, 415.1, 323; D23/383; D15/11; D32/15, 17

[56] References Cited

U.S. PATENT DOCUMENTS

| | | | |
|---|---|---|---|
| 4,132,507 | 1/1979 | Akiyama et al. | 239/136 |
| 4,269,571 | 5/1981 | Shikutani et al. | 417/234 |
| 4,746,274 | 5/1988 | Kiyooka et al. | 417/234 |

*Primary Examiner*—Lesley D. Morris

*Attorney, Agent, or Firm*—Pearne, Gordon, McCoy & Granger

[57] ABSTRACT

A flexible hose extends between the nozzle and body of a portable blower. The nozzle has a handle to enable manipulation of the nozzle. The hose is retractable into recesses in the body and nozzle and the nozzle is mountable on the body. The blower may be used in an extended or retracted position.

25 Claims, 4 Drawing Sheets

38
42
36
14
46
44
24

38
53
50
52
50
36
42
48

14
56
54
58
24

PORTABLE BLOWER WITH DETACHABLE NOZZLE

BACKGROUND OF THE INVENTION

1. Field of the Invention

This invention relates generally to the field of blowers and specifically to a blower with a detachable nozzle.

2. Description of the Related Art

Portable blowers have become popular for a variety of uses, including blowing yard debris, drying, and inflating. The blower generally includes a fan or impeller powered by an electric motor or small gasoline engine. A duct directs air to a nozzle that can be placed adjacent an area or object to be blown. Portable blowers should be relatively lightweight to permit the blower to be carried and guided by hand because the entire blower must be moved to redirect the nozzle.

U.S. Pat. Nos. 4,132,507 to Akiyama, U.S. Pat. No. 4,269,571 to Shikutani, and U.S. Pat. No. 4,746,274 to Kiyooka each show a portable blower having a nozzle attached to the body of the blower by a flexible tube. This permits the nozzle to be moved somewhat independently of the body.

It would be desirable to have the advantage of a flexible hose permitting independent movement of the nozzle, while enabling the blower to be used or stored with the nozzle rigidly fixed to the body. Detachment and reattachment of the nozzle should be simple, and air flow should be controlled.

SUMMARY OF THE INVENTION

The present invention provides a blower assembly, including a blower, a body housing the blower, and a nozzle releasably attachable to the body. A flexible hose communicating the blower with the nozzle is adapted to permit movement of the nozzle independent of the body for directing air from the blower to a selected location.

The blower includes a driver and an impeller. The body includes a compartment, the hose being retractable therein. The nozzle may also include a compartment, the hose being retractable therein. A handle is disposed on the nozzle and the nozzle is positioned to permit air from the blower to be directed at a selected location when the nozzle is attached to the body. A latch or other means for releasably attaching the nozzle to the body is provided.

The body includes an elongated neck extending from the blower. The neck has a passage therein in communication between the blower and the hose and said hose is retractable and slidable within the elongated neck. A retainer ring disposed on a proximal end of the hose is held in a bore defined by the neck. The bore has a retainer lip engageable with the retainer ring so as the retain the proximal end of the hose in the bore and permit sliding of the retainer ring along the bore. The nozzle is rotatable relative to the body and the hose is rotatable relative to at least one of the body and the nozzle.

A nozzle attachment can be located on the nozzle. The attachment is removable and rotatable relative to the nozzle. The attachment is bent and, in use, has a rotational axis that bisects an angle between two alternative directions in which the attachment is adapted to direct air from the nozzle. A vent is adapted to divert a selected volume of air from the blower to control air volume at the nozzle.

The body includes an elongated neck extending from the blower, said neck having a passage therein in communication between the blower and the nozzle, said hose being retractable around the neck. The neck includes a tapered forward end adapted to mate with a rear taper of the nozzle.

The invention also provides a blower assembly, including a blower having a driver and an impeller; a body housing the blower and having an elongated neck extending from the blower; a rear handle disposed on the body; a nozzle rigidly and releasably attachable to the body; a forward handle disposed on the nozzle; means for releasably attaching the nozzle to the body; and a flexible hose communicating the blower with the nozzle and adapted to permit movement of the nozzle independent of the body for directing air from the blower to a selected location, a proximal end of said hose being slidingly received in the neck and being retractable therein and a distal end of said hose being secured to the nozzle. The attaching means may include frictional interference between the nozzle and body; a projection disposed on one of the body and nozzle and matable with a partially helical slot disposed on the other of the body and nozzle so as to permit relative twisting and axial movement of the nozzle and body; or a tab disposed on one of the body and nozzle and insertable in a socket disposed on the other of the body and nozzle and a latch disposed opposite of the tab and socket and interlocking the forward and rear handles.

The detachable nozzle allows the heavier body to be supported by a strap or harness, thereby allowing a larger motor or engine to be used for more blowing force. In the retracted position, the nozzle and body form a compact, rigid unit usable for blowing. Because the user does not need to extensively manipulate the body, more and heavier components may be included in the body. Also, with the light weight nozzle detached from the body, the amount of time the blower can be used may be substantially extended before physical fatigue begins to affect the operator.

DESCRIPTION OF THE PREFERRED EMBODIMENTS

Figure 1:
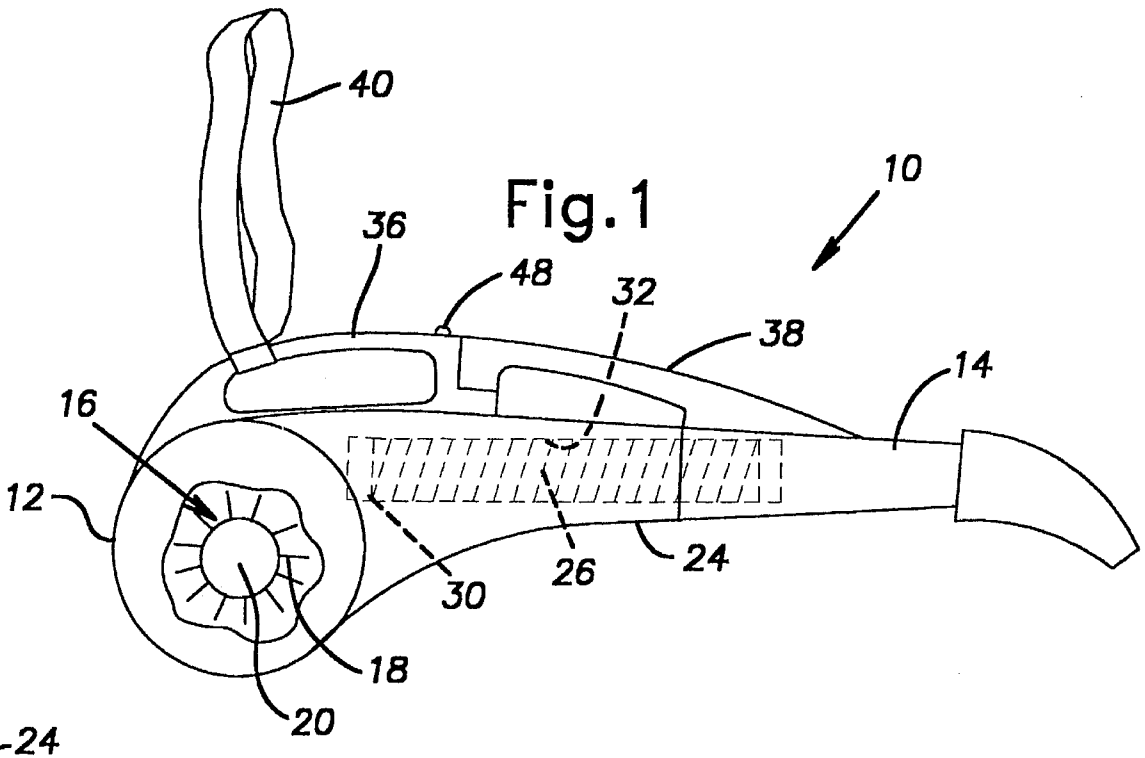
FIG. 1 shows a side elevational view of a blower assembly according to the invention with the hose in a retracted position.
Figure 2:
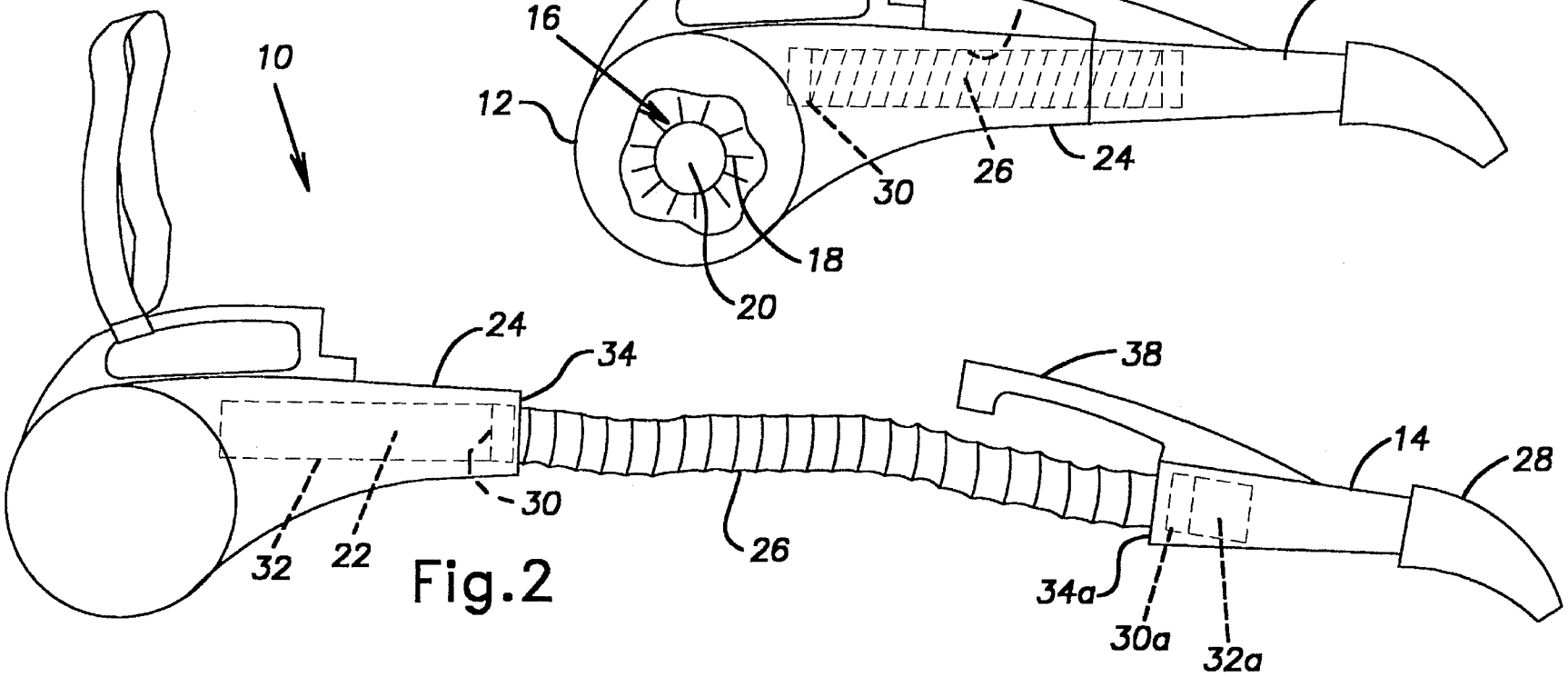
FIG. 2 shows the blower assembly of FIG. 1 with the hose in an extended position.

Referring to FIGS. 1 and 2, a blower assembly 10 includes a body 12 and a nozzle 14. Housed within the body is a blower 16 comprising a fan or impeller 18 powered by a driver, such as an electric motor 20 or gasoline engine. The blower 16 is adapted to create a flow of air through a passage 22 defined in an elongated neck 24 extending from the body 12. The passage 22 communicates with a flexible hose 26. The hose 26 communicates with the nozzle 14 to permit air flow from the blower 16 through the nozzle 14. The nozzle 14 may be provided with a removable, rotatable attachment 28 suitable for directing the air flow in a particular direction or flow pattern.

The hose 26 may be made from any flexible, relatively air impermeable material, for example vinyl with a helical reinforcing wire. Another construction might include a blow-molded configuration that consists of a blend of polyolefin plastic material. A retainer ring 30 is secured at a proximal end of the hose 26 and is adapted to slide in a generally cylindrical bore 32 defined in the neck 24. The bore is preferably concentric with the passage 22. The ring is retained in the bore 32 by a retainer lip 34 disposed at a forward end of the bore 32. A distal end of the hose 26 is secured to the nozzle 14. The distal end of the hose 26 may be slidingly disposed in the nozzle 14 by suitable means such as a retainer ring and bore (not shown). The hose 26 is preferably rotatable relative to the neck 24 and/or the nozzle 14 about a longitudinal axis.

As shown in FIG. 1, the hose 26 is retractable within the neck 24 such that the retainer ring 30 is disposed at a rear end of the bore 32. The hose 26 is compressed to permit the nozzle 14 to engage the neck 24 or body 12. The nozzle 14 can be provided with a bore **32*a* and lip 34*a* for retaining a ring 30*a* on the distal end of the hose 76, similar to those provided at the neck 24 and proximal end of the hose. The hose 26 may be retractable in either the neck 24 or the nozzle 14 or both. Referring to FIG. 2, the hose 26 is extendable from the neck 24 such that the retainer ring 30 is disposed at a forward end of the bore 32 and the nozzle 14 is separated from the body 12 and neck 24. In the extended position, the nozzle 14 can be manipulated relatively independently of the body 12 to permit air from the blower 16** to be directed to a selected location.

A rear handle 36 is provided on the body 12 and a forward handle 38 is provided on the nozzle 14. Because the heaviest components, including the blower 16, are housed in the body 12, a strap 40 or harness is provided for supporting the body. Controls for the blower 16 and other elements of the assembly 10 may be provided on the rear handle 36, forward handle 38, or both.

Figures 3, 4, 5:
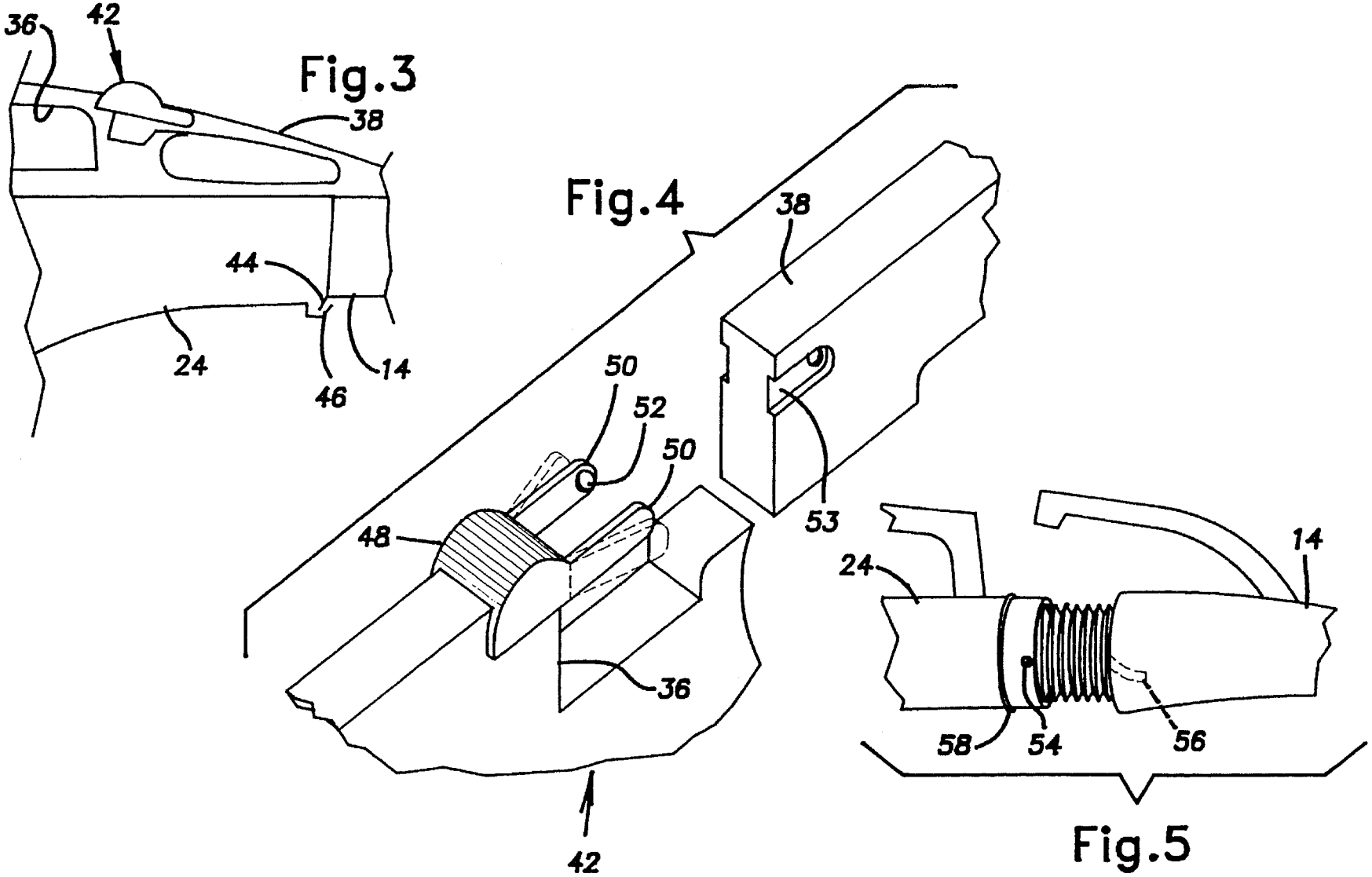
FIG. 3 shows a detail view of an attachment means according to one embodiment of the invention.
FIG. 4 shows a detail view of the attachment means of FIG. 3.
FIG. 5 shows a detail view of an alternative attachment means.

Referring to FIG. 3, the nozzle 14 is rigidly attachable to the body by a latch 42 and by a tab 44 cooperating with a socket 46. The tab 44 is disposed on a lower rear edge of the nozzle 14 and is adapted to mate with the socket 46, which is disposed on lower forward edge of the neck 14. The latch 42, shown also in FIG. 4, includes a sliding actuator 48 having a pair of opposed spring tabs 50. The spring tabs 50 are adapted to engage a pair of corresponding slots 53 in the forward handle 38 and have projections 52 adapted to be received in dimple recesses 51.

Alternatively, the nozzle 14 may be attached to the body as shown in FIG. 5. The neck 24 is provided with a pair of opposed projections 54 adapted to mate with a pair of partially helical slots 56 disposed in the nozzle 14. A rim or flange 58 may be located on the neck 24 or nozzle 14 to limit relative axial movement. The nozzle 14 is attached or removed from the neck 24 by aligning the projections 54 with open ends of the slots 56 and simultaneously rotating and longitudinally moving the nozzle 14. The nozzle 14 is frictionally maintained on the neck 24. Other attachment means may be suitable, such as a simple friction fit or other configurations of latches.

Figure 7:
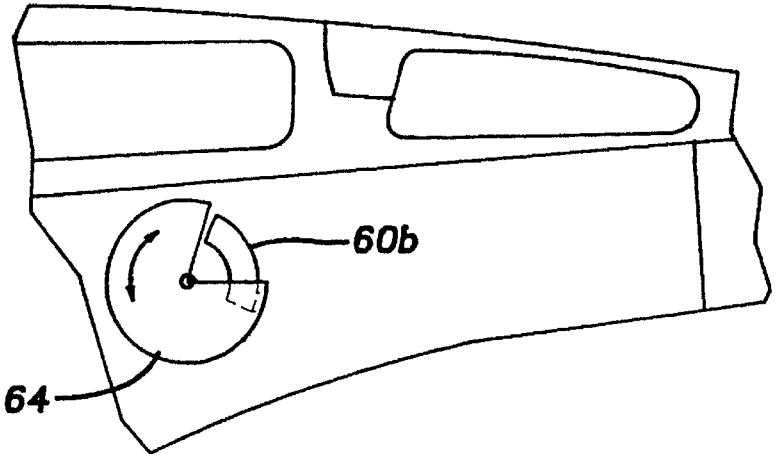
FIG. 7 shows a vent according to another aspect of the invention.
Figure 8:
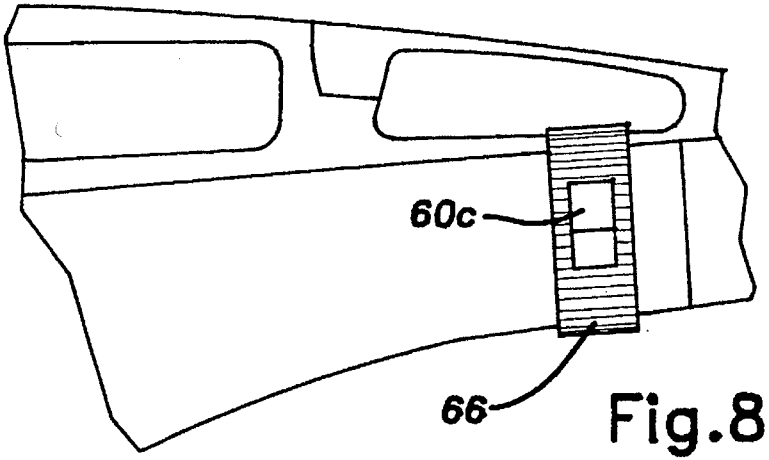
FIG. 8 shows a vent according to a further embodiment of the invention.
Figure 6:
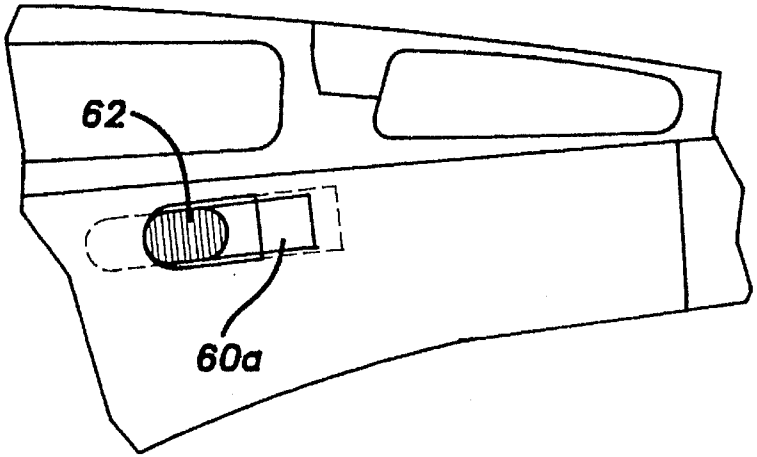
FIG. 6 shows a detail view of a vent according to one aspect of the invention.

Referring to FIGS. 6, 7, and 8, a vent **60*a*, 60*b*, or 60*c* is provided in the body 12 to communicate the passage 22 with the surrounding atmosphere. The vent 60*a*, 60*b*, or 60*c* is closed by an adjustable cover, such as a slide 62 (FIG. 6), a rotatable disk 64 (FIG. 7), or a ring 66 (FIG. 8). By adjustment of the cover, the vent 60 diverts a selected volume of air from the blower 16 away from the nozzle 14 to control the volume and velocity of air at the nozzle 14**.

Figure 9:
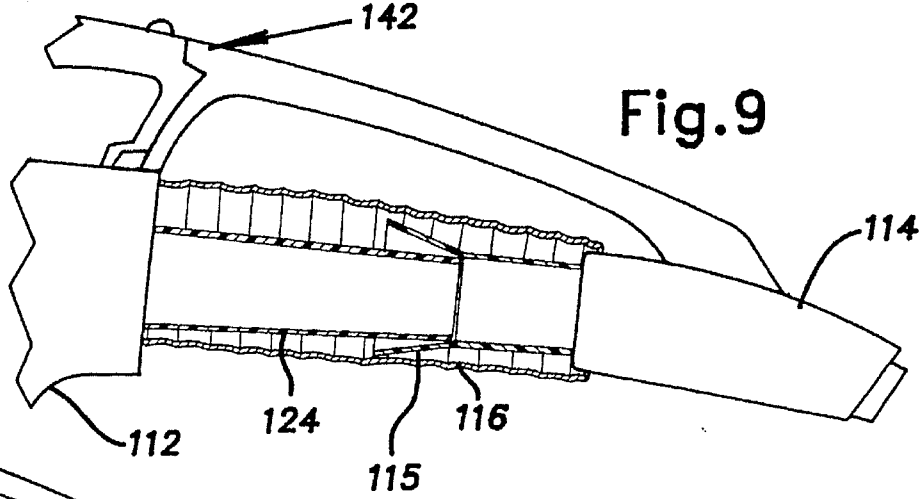
FIG. 9 shows partially cut away view of a forward part of a blower assembly according to a further aspect of the invention showing the hose in a retracted position.
Figure 10:
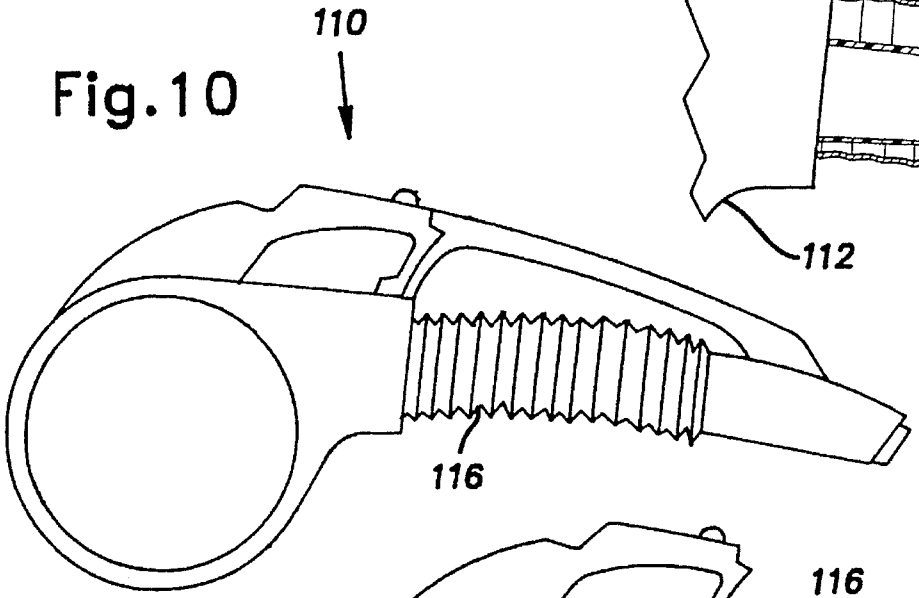
FIG. 10 shows the entire blower assembly of FIG. 9.
Figure 11:
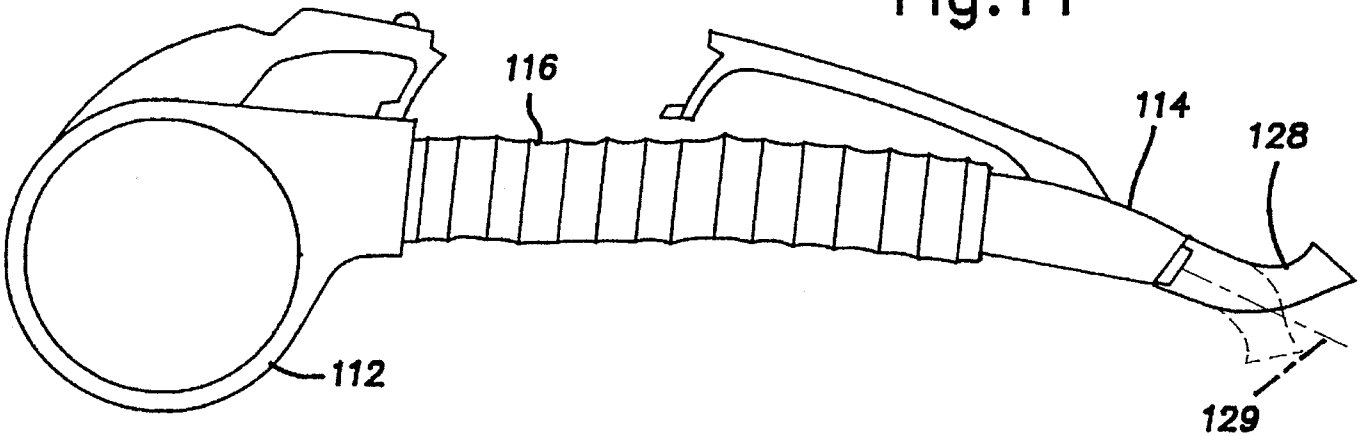
FIG. 11 shows the blower assembly of FIG. 10 with the hose in an extended position.

An alternative embodiment of a blower assembly 110 is shown in FIGS. 9, 10, and 11. A hose 116 is disposed outside of a neck 124 extending from a body 112. The neck 124 is tapered slightly so as to be receivable in a taper 115 or collar of the nozzle 114. The nozzle is attachable to the body 112 by a suitable attachment means, such as a latch 142, similar to those previously described. The hose 116 is secured between the nozzle 114 and the body 112. In a retracted position, the hose 116 is compressed around the neck 124 and the nozzle 114 is attached to the body 112, as shown in FIGS. 9 and 10. In an extended position, the nozzle 114 is separated from the body 112 and the hose 116 extends to permit movement of the nozzle 114 independent of the body 112.

As shown in FIG. 11, a curved or bent attachment 128 may be rotatably mounted on the nozzle 114. In a normal use position, a rotational axis 129 is disposed at 45° with respect to two alternative directions in which the attachment directs air from the nozzle. Thus, by rotating the attachment 128, the same attachment can be used for directing air in different directions while permitting the nozzle to be held at a single attitude. The rotational axis 129 bisects an angle between the alternative directions in which the attachment directs air.

In operation, returning to FIGS. 1 and 2, the blower assembly 10 is comfortably supported on a user's shoulder with the strap 40. The nozzle 14 is detached from the body 12, either before or after activating the blower, by sliding the latch actuator 48 to release the forward handle 38. Using the forward handle 38 the nozzle is moved to a desired position, thereby sliding the retainer ring 30 forward and extending the hose 26. The nozzle is easily movable to direct air at a desired location. When blowing is completed, the nozzle 14 is moved toward the body 12 to compress and retract the hose 26 inside the neck 24. As shown in FIGS. 3 and 4, the tab 44 is inserted in the socket 46. The nozzle 14 is tilted toward the neck 24 so that the forward handle 38 separates the spring tabs 50. The spring tabs 50 then engage the slots 53 to prevent tilting of the nozzle 14, thereby securing the nozzle on the neck 24. If desired, the blower assembly 10 may be used in its retracted position. Attachments may be removed and replaced as necessary.

The present disclosure describes several embodiments of the invention, however, the invention is not limited to these embodiments. Other variations are contemplated to be within the spirit and scope of the invention and appended claims.

What is claimed is:

1. A blower assembly, comprising:

a blower;

a body housing the blower;

a nozzle releasably attachable to the body and having a compartment; and a flexible hose communicating the blower with the nozzle, retractable in the compartment of the nozzle, and adapted to permit movement of the nozzle independent of the body for directing air from the blower to a selected location.

2. An assembly according to claim 1, wherein the blower includes a driver and an impeller.

3. An assembly according to claim 1, wherein the body includes a compartment, the hose being retractable therein.

4. An assembly according to claim 1, wherein the hose is retracted in the compartment when the nozzle is attached to the body.

5. An assembly according to claim 1, further comprising a handle disposed on the nozzle.

6. An assembly according to claim 1, wherein the nozzle is positioned to permit air from the blower to be directed at a selected location when the nozzle is attached to the body.

7. An assembly according to claim 1, further comprising means for releasably attaching the nozzle to the body.

8. An assembly according to claim 1, further comprising a latch for releasably attaching the nozzle to the body.

9. An assembly according to claim 1, wherein the body includes an elongated neck extending from the blower, said neck having a passage therein in communication between the blower and the hose and said hose being retractable within the neck.

10. An assembly according to claim 9, wherein the hose is slidable within the elongated neck.

11. An assembly according to claim 10, further comprising a retainer ring disposed on a proximal end of the hose and a bore defined by the neck, said bore having a retainer lip engageable with the retainer ring so as to retain the proximal end of the hose in the bore and permit sliding of the retainer ring along the bore.

12. An assembly according to claim 1, wherein the nozzle is rotatable relative to the body.

13. An assembly according to claim 1, wherein the hose is rotatable relative to at least one of the body and the nozzle.

14. An assembly according to claim 1, further comprising a nozzle attachment adapted to be disposed on the nozzle.

15. An assembly according to claim 14, wherein the attachment is removable.

16. An assembly according to claim 15, wherein the attachment is rotatable relative to the nozzle.

17. An assembly according to claim 16, wherein the attachment is bent and, in use, has a rotational axis that bisects an angle between two alternative directions in which the attachment is adapted to direct air from the nozzle.

18. An assembly according to claim 1, further comprising a vent adapted to divert a selected volume of air from the blower to control air volume and velocity at the nozzle.

19. A blower assembly, comprising:

a blower;

a body housing the blower;

a nozzle releasably attachable to the body;

a flexible hose communicating the blower with the nozzle and adapted to permit movement of the nozzle independent of the body for directing air from the blower to a selected location; and an elongated neck of the body extending from the blower, said neck having a passage therein in communication between the blower and the nozzle, said hose being retractable around the neck.

20. An assembly according to claim 19, wherein the neck includes a tapered forward end adapted to mate with a rear taper of the nozzle.

21. A blower assembly, comprising:

a blower having a driver and an impeller;

a body housing the blower and having an elongated neck extending from the blower;

a rear handle disposed on the body;

a nozzle rigidly and releasably attachable to the body;

a forward handle disposed on the nozzle;

means disposed on the nozzle for releasably attaching the nozzle to the body; and a flexible hose communicating the blower with the nozzle and adapted to permit movement of the nozzle independent of the body for directing air from the blower to a selected location, a proximal end of said hose being slidingly received in the neck and being retractable therein and a distal end of said hose being secured to the nozzle.

22. An assembly according to claim 21, wherein the attaching means includes frictional interference between the nozzle and body.

23. An assembly according to claim 21, wherein the attaching means includes a projection disposed on one of the body and nozzle and matable with a partially helical slot disposed on the other of the body and nozzle so as to permit relative twisting and axial movement of the nozzle and body.

24. An assembly according to claim 21, wherein the attaching means includes a tab disposed on one of the body and nozzle and insertable in a socket disposed on the other of the body and nozzle and a latch disposed opposite of the tab and socket and interlocking the forward and rear handles.

25. An assembly, comprising:

a blower;

a body housing the blower;

a nozzle releasably attachable to the body and having a compartment; and a flexible hose communicating the blower with the nozzle and adapted to permit movement of the nozzle independent of the body for directing the nozzle at a selected location, wherein the blower causes air to flow through the nozzle and the hose is retractable in the compartment of the nozzle.

* * * * *